United States Patent [19]

Ulrich

[11] 4,232,599

[45] Nov. 11, 1980

[54] WASTE PAPER COMPACTER WITH FRONT ACCESS FEATURES

[75] Inventor: James A. Ulrich, Springdale, Ark.

[73] Assignee: J. V. Manufacturing & Welding, Inc., Springdale, Ark.

[21] Appl. No.: 952,638

[22] Filed: Oct. 19, 1978

[51] Int. Cl.[2] ..... B65B 13/06; B30B 15/32

[52] U.S. Cl. ..... 100/25; 100/53; 100/218; 100/220; 100/255

[58] Field of Search ..... 100/3, 25, 218, 220, 100/53, 8, 255

[56] References Cited

U.S. PATENT DOCUMENTS

| | | | |
|---|---|---|---|
| 3,728,959 | 4/1973 | Fredrickson | 100/218 |
| 3,885,466 | 5/1975 | Cerniglia | 100/218 |
| 3,916,781 | 11/1975 | Cerniglia | 100/218 |

*Primary Examiner*—Billy J. Wilhite

*Attorney, Agent, or Firm*—Robert R. Keegan

[57] ABSTRACT

There is disclosed a waste compacter including a ruggedly constructed cage structure with a heavy lower door and lighter upper doors and a ram mounted for downward movement to compact waste in the bottom of the cage structure. A portion of the floor structure of the cage serves as an ejector; it is hinged near the front, connected at the back to a link which extends up the rear of the compacter cage, and is fitted with a hook that engages a moveable finger on the ram. The finger on the ram is arranged to be restored to an inoperative position upon downward motion of the ram. Channels or grooves are provided in the bottom surface of the ram, the rear of the compacter cage, and the floor of the compacter cage which effectively interconnect so that a fish tool may be pushed through such channels and grooves to permit a wire or cord to be drawn around three sides of the bale and tied at the front of the compacter.

14 Claims, 10 Drawing Figures

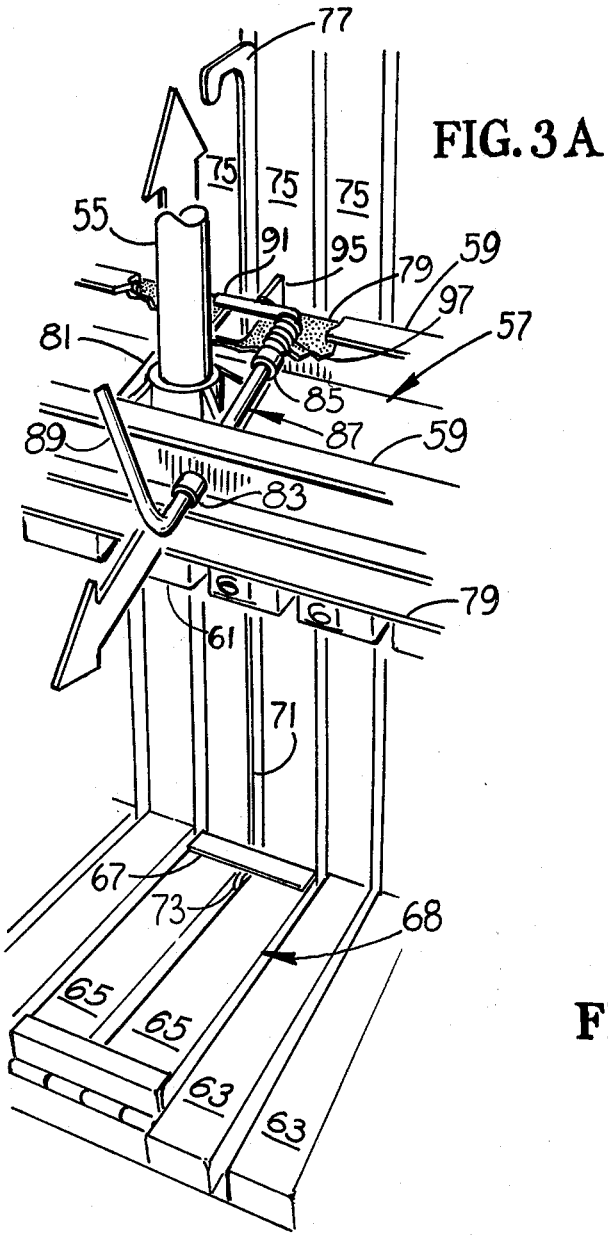
FIG. 3A
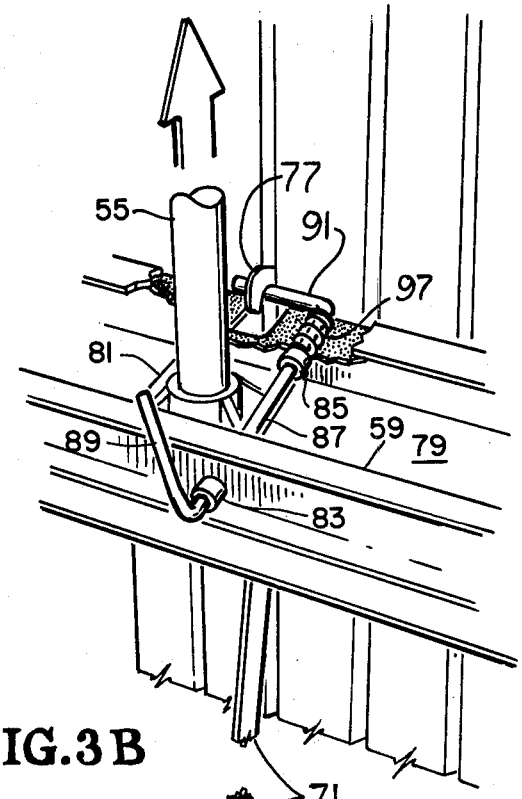
FIG. 3B
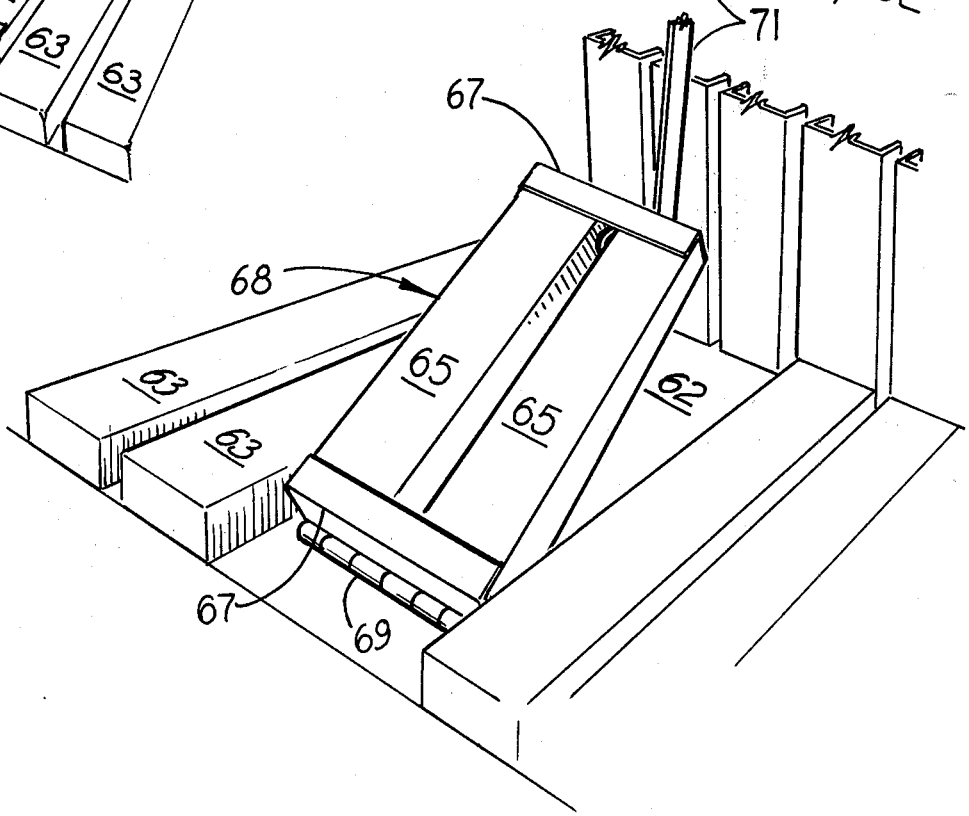

WASTE PAPER COMPACTER WITH FRONT ACCESS FEATURES

This invention relates to waste paper compacters which are commonly used in department stores, discount stores, and other establishments to facilitate disposal of waste such as corrugated paperboard or the like.

When products are received at a retail establishment they are most commonly packed in corrugated paperboard containers. These containers are discarded when the products are put on display or sold and present a significant waste removal problem for a large store. By use of a waste paper compacter such waste may be baled so that it can be readily transported to a recycling plant. This not only has the advantage of promoting recycling of the material rather than disposing of it by burning, burying or the like, but it also has the economic advantage that the waste may be sold rather than to incur the cost to have it hauled away.

Such systems of waste paper disposal utilizing large compacters for baling waste have been in use for some time. However, the compacters in use suffer from serious disadvantages which the improved compacter apparatus according to the invention overcomes. Compacters of the kind involved here are large and powerful machines and yet must be suitable for operation by persons who are not highly trained machine operators. The machines are characteristically provided with suitable electrical interlocks and other features which serve to avoid injury to the operator. It is also important, however, that the operation be as convenient as possible and that it require only the simplest sequence of operations on the part of the operator. According to the improvements provided by the present invention the sequence of operations by the operator is rendered quite simple and all such operations can be carried out from the control panel on the side of the apparatus or from the front of the compacter apparatus.

One important feature contributing to the ease of operation of the apparatus is an improved bale dumping mechanism. When a bale of corrugated paperboard has been compacted and tied, the next step in the procedure is to remove the bale from the compacter and transport it to a loading dock or other location to await transportation to a recycling facility. It is customary to place a hand truck or forklift in front of the compacter and tip or dump the bale out of the compacter onto the forklift or hand truck. This has been done in various manners which customarily involve a tedious rigging procedure on the part of the operator. For example, in some instances cables running to the bottom of the cage of the compacter were connected to the ram of the compacter and by lifting the ram the cables raised and tipped the bale out of the compacter. Following removal of the bale it was important that the cables be disconnected so that the bale ejecting apparatus not interfere with the compacting operation. The entire complicated procedure requiring access to the back of the compacter and certain skills and training on the part of the operator made the use of the waste compacting apparatus less simple and more prone to human error and mistake than it ideally should be.

By the present invention the ejection procedure for the baled waste is greatly simplified requiring only that the operator place a control handle to the eject position and raise the ram of the compacter. Upon the next lowering of the compacter ram the eject handle is restored to the inoperative position and remains so placed until the operator moves it to eject a subsequent bale.

Another important feature of the present invention concerns the procedure for tying the compacted bale to hold it together while being transported to the recycling facility. Customarily four or six wires or cords are tied around the bale for this purpose. While cords, wires or straps could be layed on the floor in front of the compacter in such a way that when the bale was dumped the ties would be partially underneath the bale and could be continued around and tied around the bale, this procedure would present a hazard that the bale would come apart when dumped out of the compacter and would otherwise be unsatisfactory. It has been customary to arrange that the bales can be tied with wire or some other form of material before removing from the compacter. To facilitate this grooves or slots were placed in the floor of the compacter and a vertical slot opening was placed at intervals along the rear of the compacter. Grooves were also utilized in the bottom surface of the ram. These grooves and slots were so arranged that a wire could be run through the groove in the ram over the bale to exit through a slot in the rear of the compacter cage. By moving to the rear of the compacter the operator could then grasp the wire and bring it downward along the side of the bale and push it back to the front of the compacter through a groove in the floor of the compacter. By moving to the front of the compacter the operator would then have access to both ends of the tie wire and could bring them together and complete the tie around the bale. Four or six such ties would be utilized to secure the bale together. Only then would the bale be removed from the compacter by whatever means provided.

The apparatus of the present invention permits substantial simplification of the bale tying process and eliminates the necessity for access to the rear of the compacter thereby permitting it to be placed close to a wall and saving floor space. In the apparatus of the present invention rather than providing only slots in the rear of the cage a guide channel is there provided for each of the tie wires. A guide element is also provided at the rear of the ram for each of the tie wires. With these improvements it is possible to feed the wire around the bale solely from the front of the machine. It may be accomplished by pushing the wire through if the wire is sufficiently stiff; or it if is not, by using a flexible fish tool which is pushed through the grooves, guides and channels around the bale and then used to pull a wire or cord back around the bottom, rear and top of the bale.

In addition to providing the above features and advantages, it is an object of the present invention to provide an improved waste compacter with an ejector which is activated by the movement of a single control handle and which is self restoring to an inoperative position.

It is another object of the present invention to provide an improved waste compacter with guide apparatus for facilitating the encirclement of the bale with tie wires or tie cords.

Other objects and advantages of the present invention will be apparent from the following description in conjunction with the appended drawings in which FIG. 1 is a perspective view of apparatus according to the invention with the doors open showing the interior of the apparatus;

FIG. 3A is a perspective partially fragmentary view showing the details of the bale ejection mechanism in the initial stages of operation;

FIG. 3B is a perspective partially fragmentary view of the apparatus of FIG. 3A near the end of the ejection operation;

Figure 1:
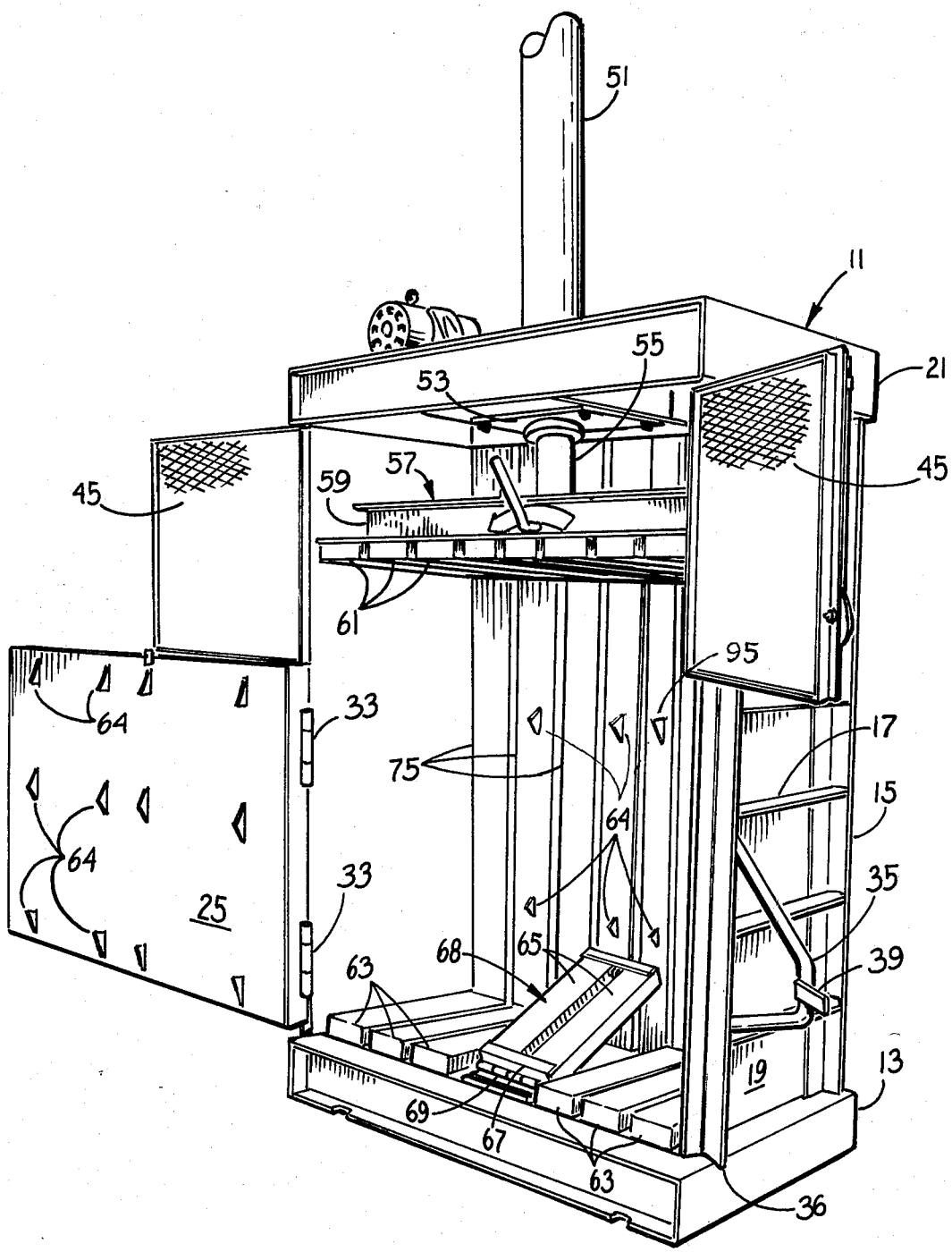
Figure 2:
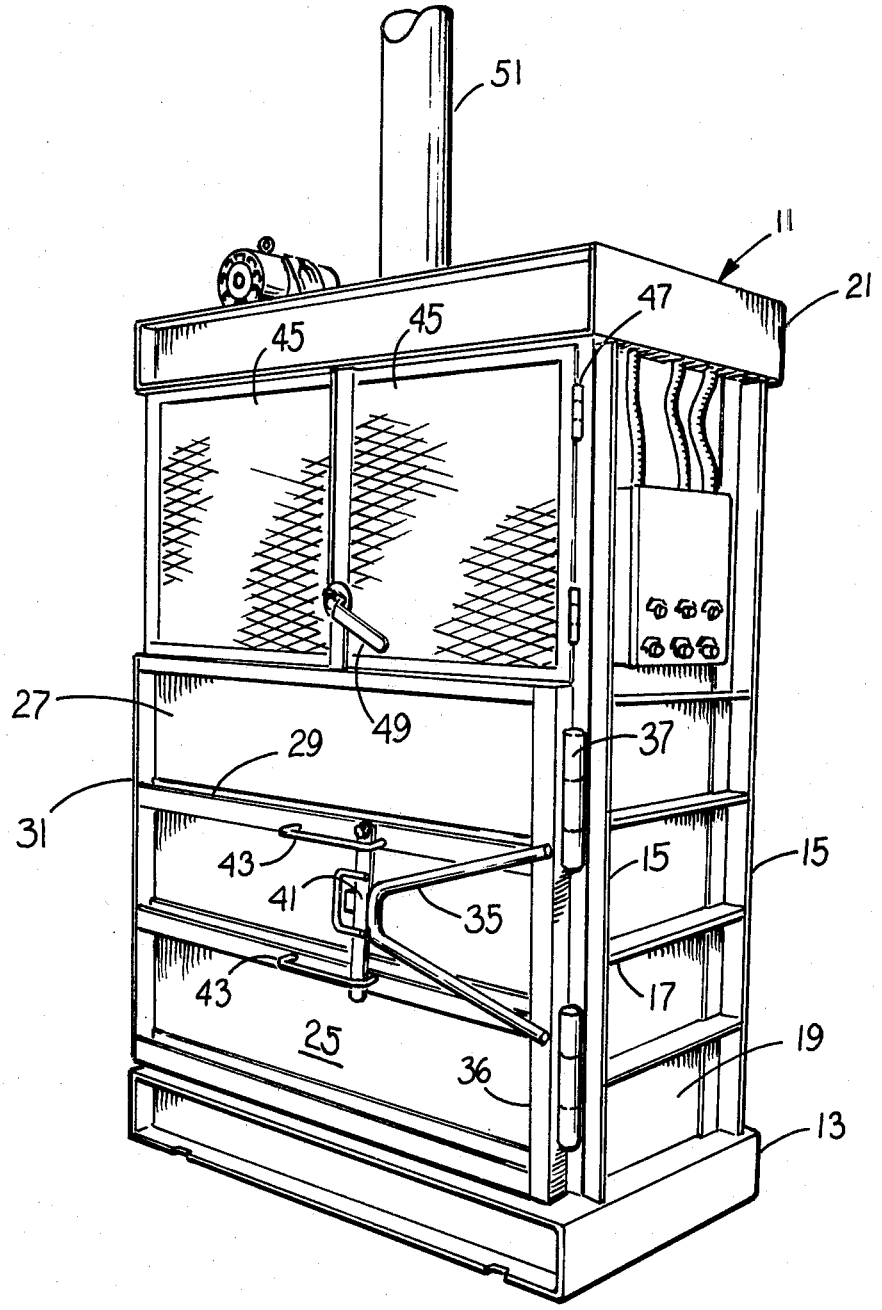
FIG. 2 is a perspective view of the apparatus of FIG. 1 showing the doors closed and the front of the exterior of the apparatus.

Referring now to the drawings and particularly FIGS. 1 and 2, there is shown a waste compacter 11. The compacter 11 comprises a cage-like structure including a base 13, vertical frame members 15, horizontal reinforcing members 17 and side wall plates 19, all of which are preferably fabricated out of heavy steel stock in the form of plates, angles, bars, etc. The compacter also includes a roof structure 21 including I-beam brace members 23 and also is constructed of heavy steel stock assembled by welding.

A heavy door 25 encloses the lower portion of the compacter cage structure and is formed of steel plate 27 with a reinforcing frame including vertical members 31 and horizontal members 29. The door 25 is hinged at the left by hinges 33 as best seen in FIG. 1.

A locking assembly 35 is provided for door 25 which includes an angle unit 36 hinged by hinges 37 to vertical structural element 15. A tab 39 on the locking assembly 35 is arranged to be engaged by a locking bar 41 pivotally attached near its top end to door 25 and further restrained by brackets 43 formed of U-shaped steel rod elements welded to the horizontal elements 29 on door 25. The apparatus is shown in closed and locked position in FIG. 2. It will be understood that the opening end of the door is secured along its full height by the hinged angle element 36 giving the closed door great structural integrity to withstand forces of the ram in the compacter. To open the door the locking bar 41 must be moved to the left to release the tab 39 so that the locking unit may be swung on hinges 37 to an outward position where the door can be opened as shown in FIG. 1.

Upper doors 45 are provided on the compacter which are of much lighter construction since they need not withstand the forces generated by the ram in the compacting operation. Doors 45 thus may be formed of a steel frame and a metal screen so that the operator may observe the interior of a compacter to some extent without opening doors 45. Doors 45 are attached to the compacter by hinges 47 and a conventional latch mechanism 49 is provided to hold the doors 45 closed.

A principal purpose of the doors 45 is to prevent the operator or other persons from reaching into the compacter when the ram is being operated. Accordingly doors 45 are preferably arranged with interlocks (not shown) which assure that the downward motion of the ram cannot be instituted unless doors 45 are closed. Similar interlocks are provided for door 25. Any usual arrangement of interlocks may be employed and thus are not shown in the drawings.

Mounted atop the compacter is a hydraulic cylinder 51 which provides the force for the compacting operation. It is mounted by means of a mounting plate 53 to the I-beam roof braces 23. The piston 55 of the cylinder 51 extends into the interior of the compacter to drive a ram 57.

Ram 57 includes a frame 59 preferably formed of a pair of I-beam stringers together with bars 61 running from the front to rear of the ram. Bars 61 may be formed of steel channel members and are spaced apart by about an inch for reasons that will be described in detail hereinafter. The structure of the ram 57 also includes a steel plate 79 between bars 61 and frame 59. Piston 55 is secured to plate 79 and to the ram 57 by a suitable flange element 81.

The floor of the compacter cage is formed of similar bar elements 63 running from front to rear of the compacter and by a floor plate 62 located underneath bars 63. In the central portion of the floor of the compacter two bar units 65 are secured together by frame members 67 by welding or otherwise and pivotally attached by a hinge 69 to floor plate 62. Hingedly attached bars 65 form an ejector 68 for the compacted bale so that it may be readily and automatically removed from the compacter. The ejector 68 is connected pivotally to a link bar 71. Link bar 71 has a projection 73 at the bottom thereof seen for example in FIG. 3A through which a pin (not shown) extends to pivotally connect link 71 and the ejector 68.

The rear wall of the compacter 11 is formed by vertical channel bars 75 which have the same spacing generally as the bars 63 in the floor and the bars 61 of the ram. At approximately the center of the back wall the link bar 77 is captured between two of the channel bars 75. The link bar 77 is free to slide up and down and for the bottom portion to the swing out with the ejector 68. A hook 77 is provided at the top of the link bar 71 to be engaged by the ram to provide the necessary force to eject the bale from the compacter.

Frame 59 is provided with bushings 83 and 85 through which passes an eject control element 87. The eject control element 87 is bent to form a handle 89 in the front and also is bent to form a finger 91 to the rear of the ram 57 which is engagable with hook 77. A steel plate 79 forms the face of the ram 57 and is notched in the rear to provide clearance for hook 77 on link bar 71.

When control handle 89 is moved to the eject position as shown in FIG. 3A or 3B, finger 91 at the rear of eject control 87 is in a horizontal position and bridges the notch in the rear of plate 79. Thus when ram 57 is raised finger 91 is in position to engage hook 77 on link bar 71 and raise ejector unit 68 as shown in FIG. 3B.

On each downward movement of the ram 57 finger 91 on control handle 87 is struck by a restoring lug 95 welded to the rear wall of the compacter somewhat below the lowermost position of hook 77, as seen in FIG. 3A for example.

Figures 4A, 4B, 4C:
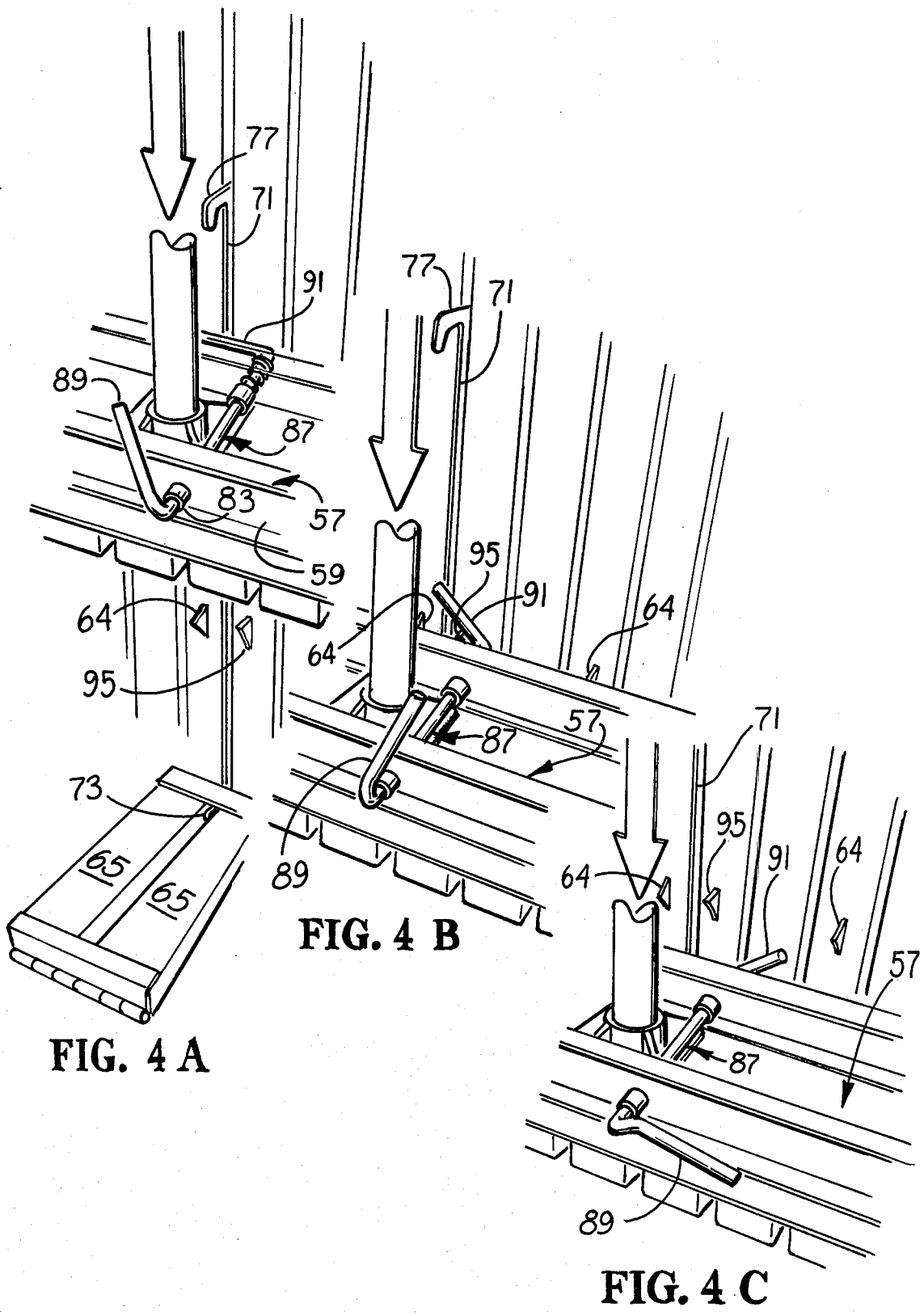
FIG. 4A is a perspective partially fragmentary view of the apparatus of FIG. 3A showing the beginning of an eject control restoring operation.
FIG. 4B is a perspective partially fragmentary view of the apparatus of FIG. 3A showing the intermediate stage of the eject control restoring operation.
FIG. 4C is a perspective partially fragmentary view of the apparatus of FIG. 3A showing the conclusion of the eject control restoring operation.

As shown in FIG. 4B the lug 95 on striking finger 91 causes handle 87 to rotate clockwise until finger 91 is nearly vertical. At this point handle 89 is somewhat to the right of vertical due to being offset relative to finger 91 and its weight carries the eject control 87 to its full clockwise position as shown in FIG. 4C. Thus whenever the ram 57 is lowered from its uppermost position the eject control is restored to the inoperative position by the action of lug 95 on finger 91. It may be noted that the length of link bar 71 is preferably sufficiently great that the ram 57 must move to its topmost position to bring the ejector the the full eject position or at an angle of about 45° with the floor.

Lug 95 has no effect on the position of eject control 87 when the ram 57 is being raised. Eject control 87 is arranged to slide in bushings 83 and 85 as well as to rotate therein. Furthermore, it is urged to the rear of the compacter by spring 97 best seen in FIGS. 3A and 3B. As a result of lug 95 being shaped with a ramp on the lower edge its interaction with eject control 87 upon raising ram 51 is only to compress spring 97 and urge eject control 87 forwardly. It imparts no rotation to eject control 87 on upward motion of the ram and thus if the eject control is placed in the eject position it remains in that position on the upward motion and it passes over lug 95. Of course if the eject control 87 is in the inoperative position there is no interaction between finger 91 and lug 95 on either the upward or downward motion of the ram.

It may be noted that there are other lugs 64 extending from various surfaces of the interior of the compacter. These lugs are employed to retain the compacted waste material in compacted condition and prevent it from expanding when the ram 57 is raised to accept more material. It will be understood that in the typical operation of the compacter it will be filled more or less with corrugated material in the form of discarded boses or parts of boxes and the ram will be lowered when the compacter will not conveniently hold more material. This will greatly compact the material and provide space for more waste material. This operation will be repeated several times before enough compacted material is accumulated to form a bale to be tied and removed from the compacter.

Figure 5:
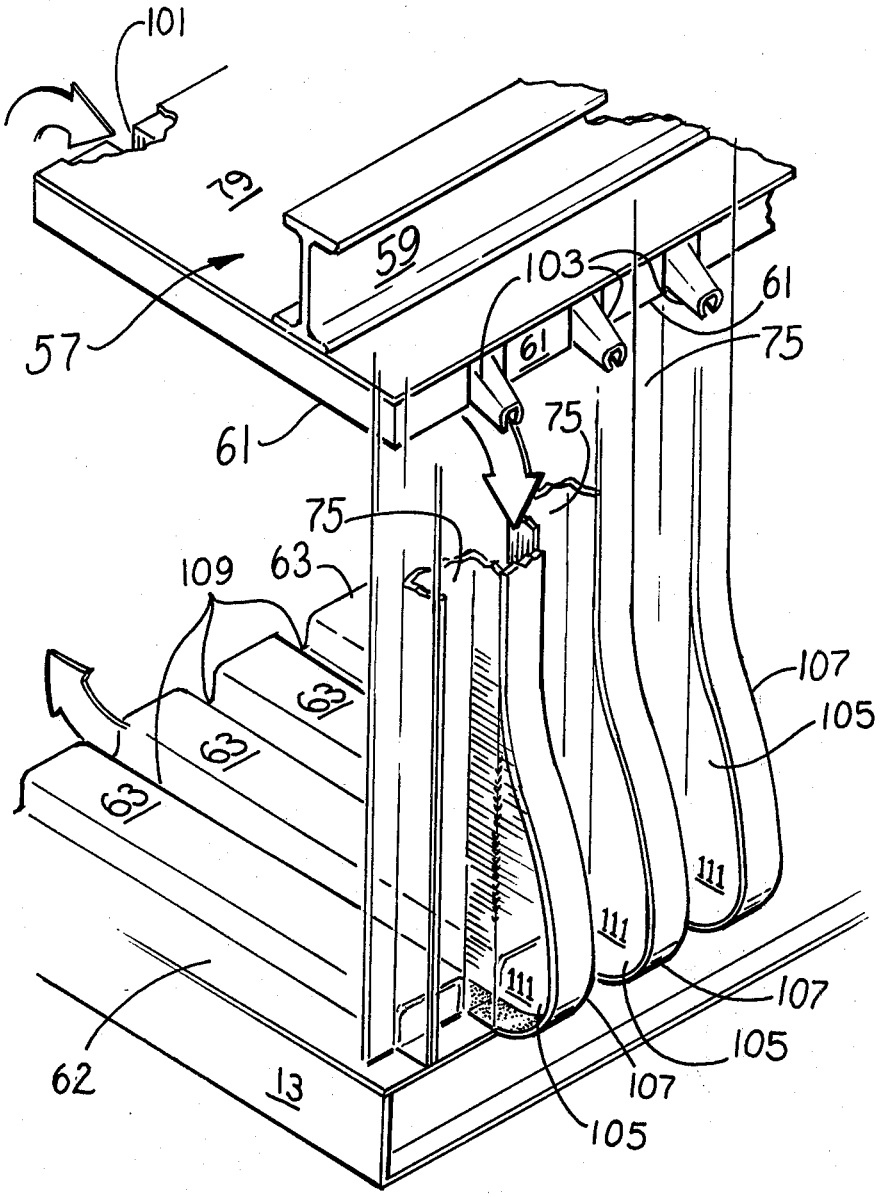
FIG. 5 is a perspective partially fragmentary view from the rear of the apparatus showing the details of the guide apparatus for the bale ties.

The tie guiding apparatus forming a part of the present invention is best understood by reference to FIG. 5 which is a perspective view extensively broken away to show portions of the ram 57, the back of the compacter formed by channel bars 75 and the floor of the compacter formed by plates 62 and bars 63. It may be mentioned at this point that, while it is not evident from the drawings, the compacter structure preferably does not have a strictly rectangular horizontal cross-section but it is slightly trapezoidal with a front wider by one or two inches than is the rear. This facilitates removal of a bale from the compacter due to the resulting taper of the sides of the compacter and of the bale formed therein.

As previously mentioned the bars 61 of which the ram lower surface is formed are spaced apart by about an inch and thus form a channel 101 between each pair of bars 61. One such channel is shown by breaking away plate 79 in FIG. 5; the front I-beam of frame 59 is also omitted for clarity in FIG. 5. Each channel 101 runs from the front to the rear of the ram and for six of such channels there is provided at the rear end an arcuate guide 103. Three such guides are shown in FIG. 5 and it will be understood that three such guides will be similarly placed at the opposite end of the ram at the termination of respective channels 101. Guides 103 are generally U-shaped and turn downward to cause a tie wire or a fish tool inserted from the front of a channel 101 to be turned at the rear of ram 57 downwardly into the space between two adjacent vertical channel bars 75.

At the bottom portion of the compacter curved plates 105 are welded to the edges of channel bars 75 and a curved backing strip 107 is welded to plates 105 and channel bars 75 in a manner to form a closed channel with a curved protrusion at the lower end. Backing strips 107 preferably extend about half way up the back wall of the compacter, that is, far enough to extend above the height of the bale in the compacter.

It should be understood that the size of the bale which may be made by the compacter is subject to considerable variation but the height of the bale will customarily be somewhat below the top of door 25 and can in no case extend above the top of door 25. In the illustrated embodiment the bale may be about three to four feet in height.

The curved projection in the channels 111 provided by curved plates 105 and the bend in backing strip 107 permit a large radius bend in a fish tool or tie wire being fed around the bale through a channel 111. The bottom of channel 111 feeds into a groove 109 formed between bars 63 and having a bottom formed by plate 62.

Figure 6:
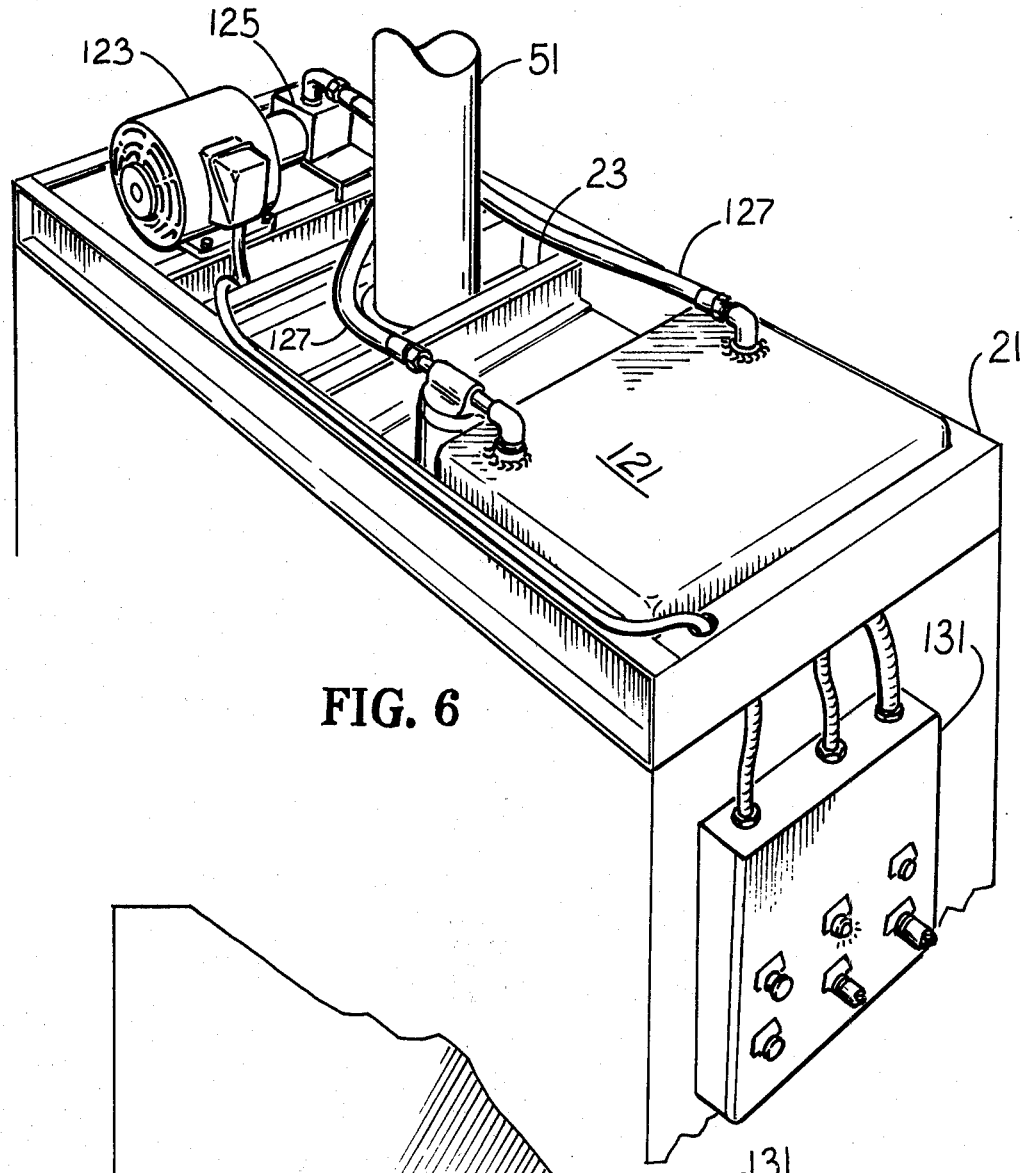
FIG. 6 is a partial perspective view from the top of the apparatus showing the ram hydraulic apparatus and the control panel.

FIG. 6 shows the top of the compacter on which is located the electric motor and hydraulic apparatus for powering the hydraulic cylinder 51 which raises and lowers ram 57. The hydraulic apparatus is in all respects conventional and is not illustrated in detail. An exemplary placement of the principal parts is illustrated with the hydraulic reservoir 121, motor 123, pump 125 and hydraulic lines 127 arranged as shown.

Figure 7:
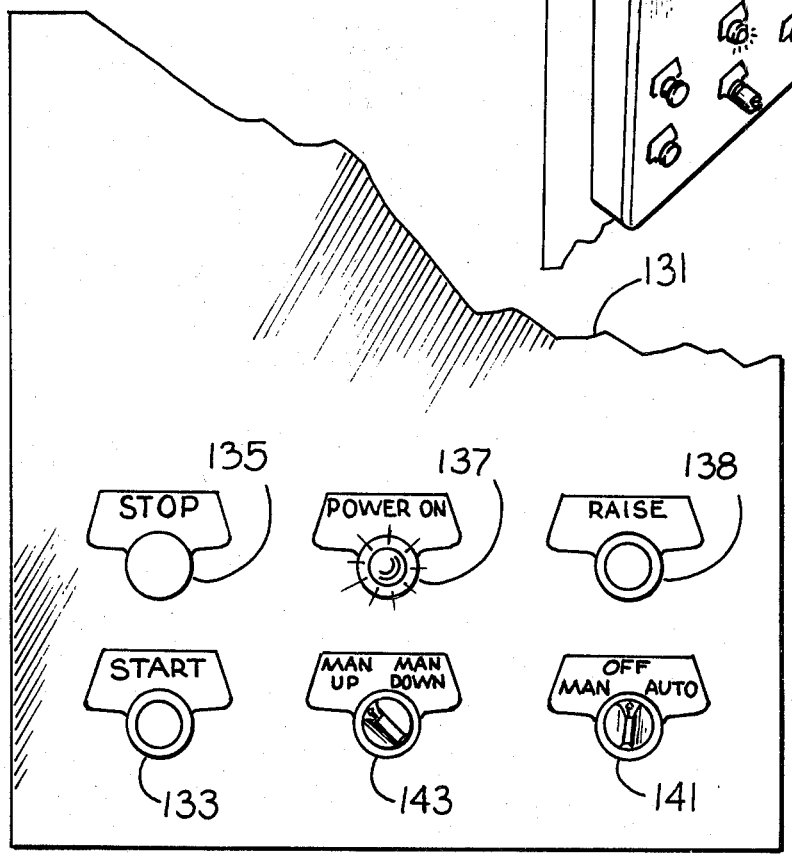
FIG. 7 is a partial enlarged elevational view of the control panel of the apparatus.

Also shown in FIG. 6 and in enlarged detail in FIG. 7 is the control panel 131. The top of the control panel is occupied by instructions, not shown, and the bottom has mounted thereon control buttons, switches and an indicator. A conventional stop-start button 133 is provided together with a conventional stop button 135. A "power on" indicator light 137 is also conventional.

"Raise" control button 138 is instrumented to cause the ram to be raised to the top and stop automatically. The mode of operation is controlled by a mode control switch 141 which sets the compacter in the manual mode, the automatic mode or in the off position. An up-down switch 143 sets the compacter for manual up motion or manual down motion corresponding to the setting of switch 143. Whether on manual or automatic control the compacter ram cannot be lowered without holding down a control button thus causing the operator to stand to the side of the compacter and minimizing possibility of injury. As previously mentioned the compacter is provided with interlocks, now shown, which are conventional and prevent downward motion of the ram unless both door 25 and doors 45 are closed and locked. The nature of the control system, being immaterial to the improvements to which the invention relates, has not been shown or described in detail.

The operation of the apparatus may be summarized as follows. The door 25 of the compacter is kept closed and locked except during bale removal. The doors 45 may be left open or they may be closed except when waste is to be dumped into the compacter. The ram 57 is normally raised to its topmost position.

Waste which is collected is deposited through the opening in the top of the compacter with doors 45 open and collects behind door 25. When a substantial amount of waste such as corrugated boxes and cartons is collected the doors 45 are closed and locked and the ram 57 is operated to compress the waste in the compacter thereby making room for the collection of more waste. The ram is then raised so that more waste can be deposited in the compacter. When this sequence has been completed a number of times the bale being formed in the bottom of the compacter will reach a height such that it may be tied and removed. As previously stated the height of the bales may vary and will depend on the particular nature of the operation, the density of the materials being compacted and the approximate weight of the bales which it is desired to produce.

When the bale has reached a desired height and volume the ram 57 will be lowered one final time and doors 45 and door 25 will be opened. The bale will be tied by inserting a fish tool consisting of a tightly coiled steel spring about eight feet in length and one-quarter inch in diameter into grooves 101 in the bottom surface of ram 57 and pushing the fish tool through groove 101, guide 103, channel 111 and groove 109 in the floor of the compacter until the end of the fish tool is accessible at the bottom front of the bale. A cord or wire is thereupon connected to the end of the fish tool and the fish tool withdrawn drawing the wire or cord around the bale where it may be tied, twisted or otherwise fastened at the front of the bale. By use of tie wire of proper stiffness it may be threaded directly without employing a fish tool.

Ties are made utilizing all or some of the six grooves and channels provided for such purpose until the bale is adequately secured. The handle 89 of the eject control 87 is then turned to the left upright position as shown in FIG. 1 and the ram is raised by operation of the appropriate control button. The eject control finger 91 engages the hooks 77 of link bar 71 and lifts the ejector element 68 causing the bale to be dumped out of the compacter onto a forklift or hand cart placed in front of the compacter to receive the bale. The finished bale is removed, the doors closed, and the ram is lowered to lower the ejector 68 at which time the handle 89 of the ejector control is automatically restored to the inoperative position at the right. The ram is then again raised and the compacter is then ready to accept further waste to be formed into another bale.

From the foregoing description and explanation it will be seen that improved waste compacter apparatus is provided by the invention which is capable of being efficiently used by relatively untrained operators and which overcomes disadvantages relating to efficiency and safety which were present in previous apparatus.

While the apparatus illustrated is shown of particular size and proportion it may be made larger or smaller to fit the circumstances for which it is to be used. Furthermore, while the apparatus is shown with a hydraulically driven ram, electrically driven rams might be employed in the apparatus. Furthermore, the particular physical structure, while it is found to be particularly suitable and provide a rugged and durable apparatus, is not the only structure which may be employed. In addition to the above suggested modifications and variations in the apparatus, numerous other modifications and variations will be apparent to those skilled in the art and accordingly the scope of the invention is not to be deemed to be limited to the particular variations shown, described or suggested but is rather to be determined by reference to the appended claims.

What is claimed is:

1. In a compactor apparatus comprising a cage with a door and a compacting ram for forming bales of waste material, the improvement of a bale ejector comprising, a tiltable floor element in the bottom of said cage pivotable about an axis near the vertical plane of said door and parallel thereto, a vertical link engaging the rear of said floor element with its bottom and extending upwardly to a height at least slightly greater than the bale height, said link having a hook on the upper portion thereof, a latch member connected to move with said compacting ram and adapted to engage the hook of said link when the compacting ram is moved from its lower position to its upper position, said latch member being movable between an operative position and an inoperative position at which it does not engage the hook of said link, said latch member including a shaft extending along the top center of said ram from the door side thereof to the opposite side thereof, a handle on the door end of said shaft and an arm on the opposite end of said shaft, said arm being positioned to be movable into and out of an engagement position with the hook of said link, and a toggle element fixed relative to said cage adapted to move said latch member to the inoperative position upon downward movement of said ram, said toggle element being provided with a ramp shaped lower portion and an approximately horizontal upper portion and said shaft of said latch member being spring loaded away from said door and towards said toggle element and said toggle element being positioned to strike said arm causing it to rotate to an inoperative position when the motion of said arm is downward and causing it to slide over said ramp portion without rotation when said ram motion is upward.

2. Apparatus as claimed in claim 1 wherein said vertical link is pivotally attached to said floor element and the top thereof is slidably mounted in the side of said cage opposite said door.

3. In a compacter apparatus comprising a cage with a door and a vertically movable ram the improvement of a bale ejector comprising, a tiltable element in the bottom of said cage pivotable about a horizontal axis parallel to and inside the vertical plane of said door, a generally vertical link with its bottom end engaging the rear of said element and restrained to move in an arc centered on said horizontal axis, and its top slidably retained at one wall of said cage, and a latch member connected to move with said ram and adapted to engage the top of said link, said latch member being movable to an inoperative position at which it does not engage said link.

4. Apparatus as claimed in claim 3 wherein said vertical link is pivotally attached to said floor element and the top thereof is slidably mounted in the side of said cage opposite said door.

5. Apparatus as claimed in claim 3 further including a toggle element in said cage adapted to place said latch member in the inoperative position upon downward movement of said ram.

6. In a compactor apparatus comprising a cage with a door in the front thereof and a compacting ram for forming bales of waste material, the improvement of bale tying apparatus comprising, a plurality of inverted channels in the bottom of said ram running from the front to the rear thereof adapted to accept a tie wire or a fish tool, a plurality of forward-opening channels in the rear of said cage extending from the bottom thereof upward by a distance at least equal to a bale height, each said channel in the rear of said cage being positioned to communicate with the rear end of a channel in the bottom of said ram.

a downwardly curved guide at the rear of each of said inverted channels adapted to turn and guide a tie wire or fish tool from said inverted channel into the corresponding forward opening channel in the rear of said cage, and a plurality of upwardly-opening channels in the floor of said cage each communicating with a corresponding one of said forward-opening channels in the rear of said cage.

7. Apparatus as claimed in claim 6 wherein each of said forward-opening channels has an arcuate lower portion leading into it corresponding upwardly-opening channel with a minimum radius of curvature of at least one-inch.

8. Apparatus as claimed in claim 7 wherein said curved guide extends at least partly into the corresponding channel in the rear of said cage.

9. Apparatus as claimed in claim 6 wherein said curved guide extends at least partly into the corresponding channel in the rear of said cage.

10. In a compacter apparatus comprising a cage with a door in the front thereof and a compacting ram for forming bales of waste material, the improvement of bale tying apparatus comprising, at least three inverted channels in the bottom of said ram running from the front to the rear thereof adapted to accept a tie wire or a fish tool, at least three forward-opening channels in the rear of said cage extending from the bottom thereof upward by a distance at least equal to a bale height, each said channel in the rear of said cage being positioned to communicate with the rear end of a channel in the bottom of said ram, a downwardly curved guide at the rear of each said inverted channel extending at least partly into the corresponding forward-opening channel in the rear of said cage and adapted to turn and guide a tie wire or fish tool from said inverted channel into the corresponding forward-opening channel in the rear of said cage, and at least three upwardly-opening channels in the floor of said cage each communicating with a corresponding one of said forward-opening channels in the rear of said cage and extending to the front of said cage.

11. Apparatus as claimed in claim 10 wherein each of said forward-opening channels has an arcuate lower portion projecting from the rear of said cage leading into its corresponding upwardly-opening channel with a minimum radius of curvature of at least one-inch.

12. In a compacter apparatus comprising a cage with a door and a vertically movable ram the improvement of a bale ejector comprising, a tiltable element in the bottom of said cage pivotable about a horizontal axis parallel to and inside the vertical plane of said door, a generally vertical link with a length greater than the bale height with its bottom end engaging the rear of said element and a hook at its top constrained to vertically slidable movement retained at one wall of said cage, a latch member connected to move with said ram and adapted to engage said hook, said latch member being movable to an inoperative position at which it does not engage said hook, and a toggle element in said cage at a level below the lowest position of said hook adapted to place said latch member in the inoperative position.

13. Apparatus as claimed in claim 12 wherein said latch member includes an arm near the center of said ram opposite the door side thereof, said arm being positioned to be movable into and out of an engagement position with the hook of said link.

14. Apparatus as claimed in claim 13 wherein said toggle element is fixed at the rear of said cage and provided with a ramp shaped lower portion and an approximately horizontal upper portion and is positioned to strike said arm causing it to move to an inoperative position when the motion of said ram is downward and causing it to slide over said ramp portion without movement to an inoperative position when said ram motion is upward.

* * * * *